US008733122B2

(12) United States Patent
Lim et al.

(10) Patent No.: US 8,733,122 B2
(45) Date of Patent: May 27, 2014

(54) REFRIGERATOR HAVING DRAWER

(75) Inventors: Jae Hoon Lim, Suwon-si (KR); Dae Jin Hong, Jeonam (KR); Sung Il Park, Gwangju (KR); Ji Sick Hwang, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 557 days.

(21) Appl. No.: 13/064,472

(22) Filed: Mar. 28, 2011

(65) Prior Publication Data

US 2011/0259036 A1 Oct. 27, 2011

(30) Foreign Application Priority Data

Apr. 21, 2010 (KR) ..... 10-2010-0036657
Feb. 8, 2011 (KR) ..... 10-2011-0010832

(51) Int. Cl.
*F25C 5/18* (2006.01)

(52) U.S. Cl.
USPC ..... 62/344

(58) Field of Classification Search
USPC ..... 62/137, 340, 344, 66
See application file for complete search history.

(56) References Cited

U.S. PATENT DOCUMENTS

| | | | | |
|---|---|---|---|---|
| 2,490,494 | A | 4/1947 | Widman | |
| 6,708,509 | B1 * | 3/2004 | Senner | 62/137 |
| 6,732,537 | B1 | 5/2004 | Anell et al. | |
| 2007/0151281 | A1 * | 7/2007 | Jackovin | 62/344 |

FOREIGN PATENT DOCUMENTS

| | | |
|---|---|---|
| CN | 2085049 | 9/1991 |
| CN | 2660436 | 12/2004 |
| JP | 08-100977 | 4/1996 |
| JP | 09-126627 | 5/1997 |
| JP | 2001-021252 | 1/2001 |
| WO | WO 2005/010447 | 2/2005 |

OTHER PUBLICATIONS

Extended European Search Report Issued Sep. 12, 2013 in corresponding European Application No. 11 16 0426.

* cited by examiner

*Primary Examiner* — Melvin Jones
(74) *Attorney, Agent, or Firm* — Staas & Halsey LLP

(57) ABSTRACT

A refrigerator having a drawer to be pushed into or pulled out of a storage compartment. An ice-making unit is integrally mounted in the drawer so as to be pushed into or pulled out of the drawer through an opening perforated in a front wall of the drawer, resulting in improved use convenience and space utilization.

17 Claims, 6 Drawing Sheets

REFRIGERATOR HAVING DRAWER

CROSS-REFERENCE TO RELATED APPLICATIONS

This application claims the benefit of Korean Patent Application No. 2010-0036657, filed on Apr. 21, 2010 and Korean Patent Application No. 2011-0010832, filed on Feb. 8, 2011 in the Korean Intellectual Property Office, the disclosures of which are incorporated herein by reference.

BACKGROUND

1. Field

Embodiments relate to a refrigerator having a drawer in which an ice-making unit is received.

2. Description of the Related Art

Generally, a refrigerator is a device to keep food fresh at a low temperature by supplying low-temperature cold air to a storage compartment in which food is stored. The refrigerator includes a freezing compartment in which food is kept at a freezing temperature or less and a refrigerating compartment in which food is kept at a temperature slightly above freezing In recent years, a refrigerator, in which an ice-making unit to make ice is installed in a freezing compartment, has been developed. The ice-making unit includes an ice-making tray in which ice is made, an ice receptacle placed below the ice-making tray to receive ice, and an icemaker body in which the ice-making tray and the ice receptacle are separably mounted, the icemaker body being installed so as to be pushed into or pulled out of the freezing compartment.

The ice-making unit may be separately prefabricated and mounted into the freezing compartment, or a space defined in a wall surface of the freezing compartment so as to be pushed into or pulled out of the space.

SUMMARY

Therefore, it is one aspect to provide a refrigerator to improve space utilization of a storage compartment thereof.

It is another aspect to provide a refrigerator to improve use convenience thereof.

Additional aspects will be set forth in part in the description which follows and, in part, will be apparent from the description, or may be learned by practice of the invention.

In accordance with one aspect, a drawer for a refrigerator, configured to be pushed into or pulled out of a storage compartment of the refrigerator and includes a bottom surface, and a vertical wall including a front wall, a rear wall and opposite sidewalls extending upward from a periphery of the bottom surface, wherein the interior of the drawer is divided into a plurality of receiving spaces to receive food, wherein any one of the plurality of receiving spaces receives an ice-making unit to make ice, and wherein the front wall defining the receiving space, in which the ice-making unit is received, is provided with an ice-making unit entrance/exit opening to allow the ice-making unit to be pushed into or pulled out of the receiving space.

The ice-making unit may include an ice-making tray in which ice is made, and an ice receptacle to store the ice made in the ice-making tray, and at least one of the ice-making tray and the ice receptacle is slidably pushed into or pulled out of the receiving space through the ice-making unit entrance/exit opening.

The drawer may further include a tray to cover an upper side of the receiving space in which the ice-making unit is received.

The tray may be supported on an upper end of the vertical wall of the drawer in a sliding movable manner.

The drawer may be provided with a cold air inlet hole, through which cold air is supplied into the ice-making unit.

The cold air inlet hole is provided at the rear wall.

The ice-making tray may include a frame having open upper and lower sides, an ice-making container rotatably placed in the frame, in which ice is made, and a rotation grip provided at a front surface of the frame and connected to the ice-making container to rotate the ice-making container.

In accordance with another aspect, a refrigerator includes a storage compartment, a door to open or close the storage compartment, a drawer provided to be pushed into or pulled out of the storage compartment and serving to receive food therein, a partition to divide the interior of the drawer into a plurality of independent receiving spaces, an ice-making unit received in any one of the plurality of receiving spaces and serving to make ice, and an ice-making unit entrance/exit opening provided in a portion of a vertical wall of the receiving space in which the ice-making unit is received, to allow the ice-making unit to be pushed into or pulled out of the receiving space.

The storage compartment may include a refrigerating compartment and a freezing compartment, and the drawer may be arranged in the freezing compartment.

The ice-making unit may include an ice-making tray in which ice is made, and an ice receptacle to store the ice made in the ice-making tray, and at least one of the ice-making tray and the ice receptacle may be slidably pushed into or pulled out of the receiving space through the ice-making unit entrance/exit opening.

A cold air inlet hole, through which cold air is supplied into the ice-making unit, may be provided in a wall of the drawer defining the receiving space in which the ice-making unit is received.

The ice-making unit may further include a cold air guide cover placed on the ice-making tray.

The drawer may include a tray to cover an upper side of the receiving space in which the ice-making unit is received.

The tray may be supported on an upper end of the drawer in a sliding movable manner.

The ice-making tray may include a frame, an ice-making container rotatably placed in the frame, in which ice is made, and a rotation grip provided at a front surface of the frame and rotatably linked to the ice-making container.

The ice-making unit may be a manual icemaker in which ice is separated from the ice-making tray via distortion of the ice-making tray.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
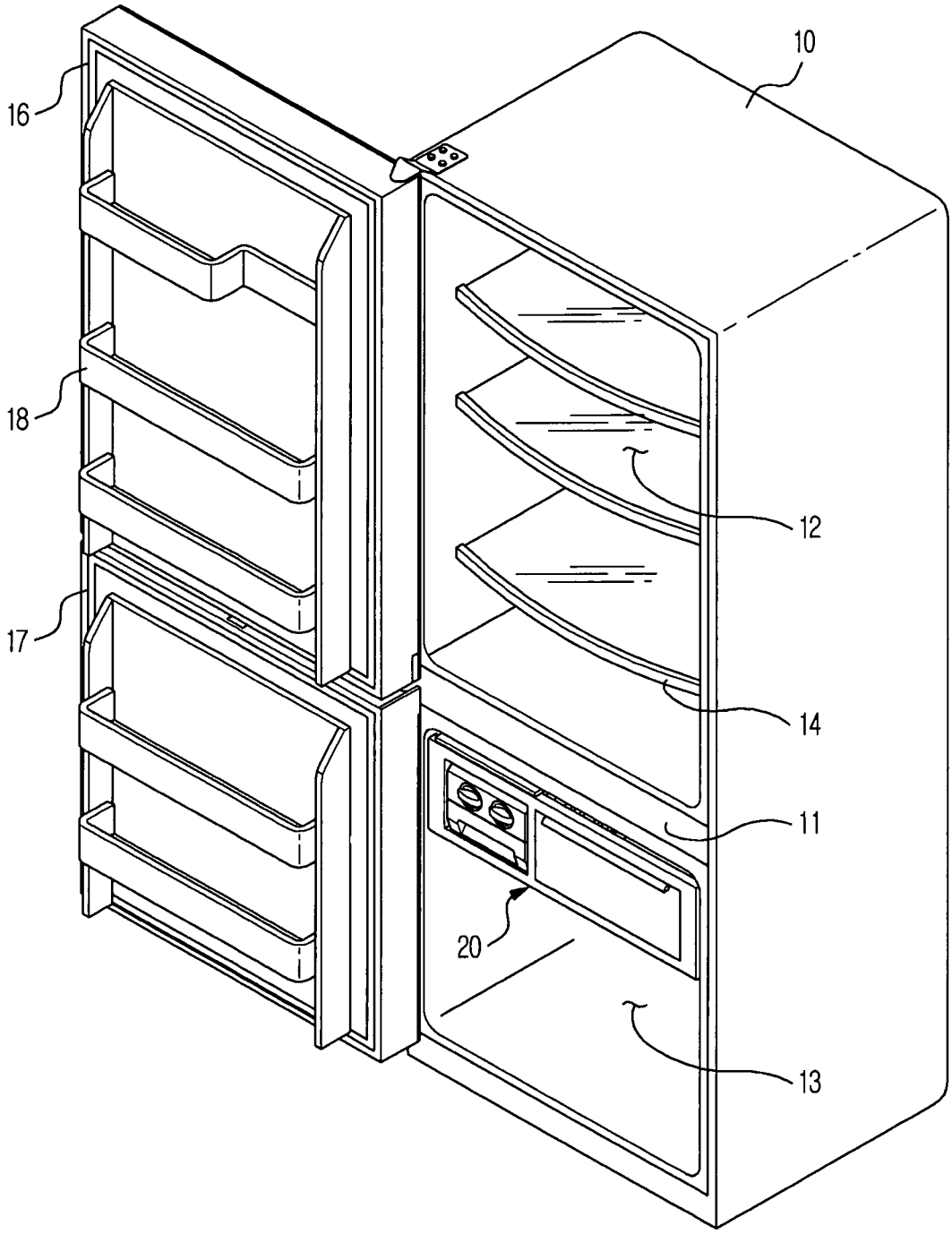
FIG. 1 is a perspective view illustrating an interior configuration of a refrigerator according to an exemplary embodiment.

Reference will now be made in detail to the embodiments of the present invention, examples of which are illustrated in the accompanying drawings, wherein like reference numerals refer to like elements throughout.

Hereinafter, a refrigerator according to the exemplary embodiment will be described with reference to the accompanying drawings.

Figure 2:
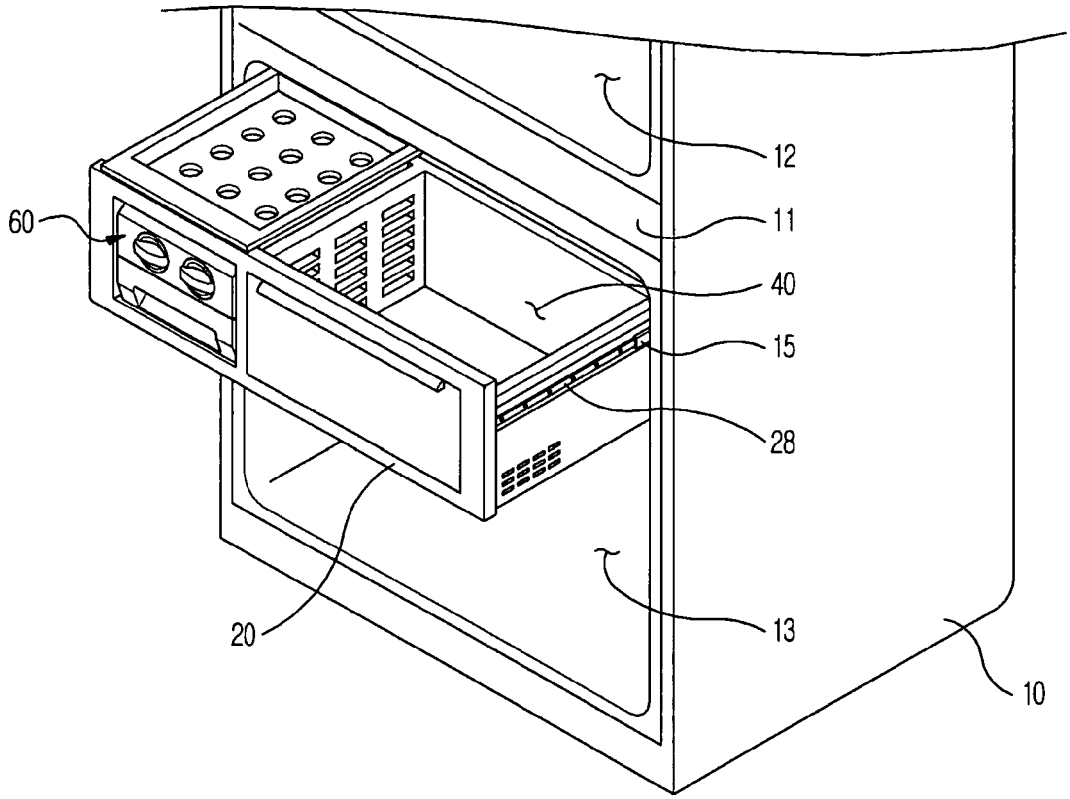
FIG. 2 is a perspective view illustrating a state in which a drawer is pulled out of the refrigerator according to the exemplary embodiment.

FIG. 1 is a perspective view illustrating an interior configuration of a refrigerator according to the exemplary embodiment, and FIG. 2 is a perspective view illustrating a state in which a drawer is pulled out of the refrigerator according to the exemplary embodiment.

Referring to FIG. 1, the refrigerator according to the exemplary embodiment includes a main body 10 in which storage compartments 12 and 13 are defined, and doors 16 and 17 to open or close an open front side of the main body 10.

The storage compartments 12 and 13 may include an upper first storage compartment 12 and a lower second storage compartment 13 divided from each other by a horizontal partition 11.

The refrigerator according to the exemplary embodiment is a Bottom Mounted Freezer (BMF) type refrigerator, and thus, the first storage compartment 12 may serve as a refrigerating compartment and the second storage compartment 13 may serve as a freezing compartment.

Controlling temperatures of the storage compartments 12 and 13 individually may be possible, to allow the first storage compartment 12 to serve as a freezing compartment and the second storage compartment 13 to serve as a refrigerating compartment or to allow both the first and second storage compartments 12 and 13 to serve as freezing compartments or refrigerating compartments. Also, the number of storage compartments is not limited to two.

A machine room (not shown), in which a variety of electric parts are received, is defined in a lower rear region of the body 10. The machine room may receive, e.g., a compressor (not shown) and a condenser (not shown) of a refrigeration cycle and an electric box (not shown).

The doors 16 and 17 may include a refrigerating compartment door 16 to open or close the refrigerating compartment 12, and a freezing compartment door 17 to open or close the freezing compartment 13.

A plurality of door guards 18 may be provided at inner surfaces of the doors 16 and 17 to store, e.g., beverages and small volume food items therein.

Also, the upper refrigerating compartment 12 may contain a plurality of shelves 14 to support food placed thereon, and the lower freezing compartment 13 may contain a drawer 20 to receive food therein. The drawer 20 is movably installed so as to be pushed into or pulled out of the freezing compartment 13.

Referring to FIG. 2, the drawer 20 takes the form of a slidable container and may slide on rails 15 provided at opposite wall surfaces of the freezing compartment 13 so as to be pushed into or pulled out of the freezing compartment 13. To this end, the drawer 20 may be provided at opposite sides thereof with guides 28 supported on the rails 15.

The drawer 20 internally defines a receiving space 40 in which, e.g., food is received. An ice-making unit 60 to make ice may be integrally mounted in a partial region of the receiving space 40.

In the exemplary embodiment, integrally mounting the ice-making unit 60 in the receiving space 40 of the drawer 20 may reduce an unavailable space of the freezing compartment 13 required to install the ice-making unit 60, thereby improving space utilization of the freezing compartment 13.

More specifically, an ice-making unit has been conventionally mounted in a freezing compartment using additional structures, such as rails or partitions, provided at an inner shell of the freezing compartment. However, these structures occupy a space inside the freezing compartment, thus limiting the volume of the freezing compartment. Since the ice-making unit 60 according to the exemplary embodiment is integrated in the drawer 20 that is slidable inward or outward of the freezing compartment 13, it may be possible to reduce an unavailable space of the freezing compartment 13 required to install the ice-making unit 60.

Figure 3:
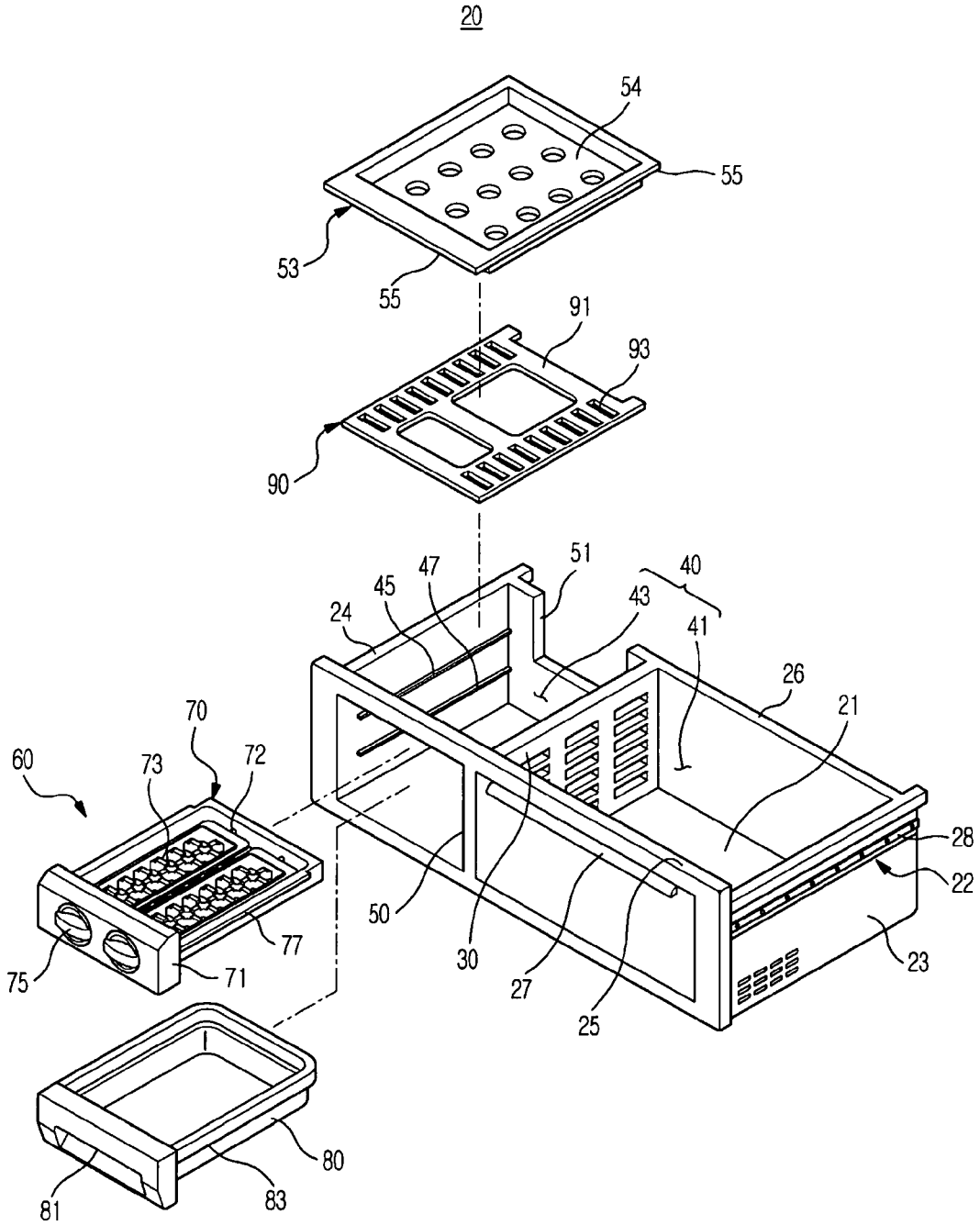
FIG. 3 is an exploded perspective view of the drawer of the refrigerator according to the exemplary embodiment.
Figure 4:
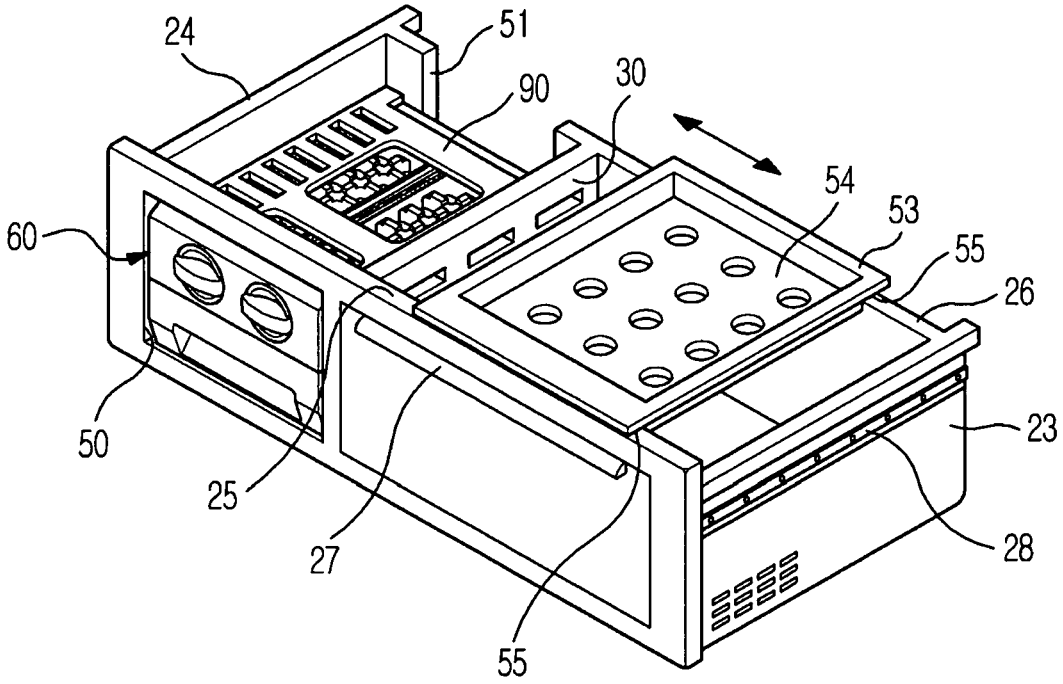
FIG. 4 is a perspective view illustrating operation of the drawer of the refrigerator according to the exemplary embodiment.

FIG. 3 is an exploded perspective view of the drawer according to the exemplary embodiment, and FIG. 4 is a perspective view illustrating operation of the drawer according to the exemplary embodiment.

Referring to FIG. 3, the drawer 20 of the refrigerator may take the form of an upwardly open box having a bottom surface 21 and a vertical wall 22 extending upward from the periphery of the bottom surface 21 so as to define the receiving space 40 for food storage.

The vertically wall 22 may be composed of opposite sidewalls 23 and 24 extending upward from opposite lateral edges of the bottom surface 21, and front and rear walls 25 and 26 extending upward from front and rear edges of the bottom surface 21.

The receiving space 40 may contain a partition 30 to divide the receiving space 40 into a plurality of spaces. More specifically, both ends of the partition 30 may come into contact with the front and rear walls 25 and 26 of the drawer 20 respectively so as to divide the receiving space 40 into two independent left and right spaces. The partition 30 may be integrally formed with the drawer 20, or may be separately molded and mounted in the drawer 20.

Accordingly, the receiving space 40 may consist of a first receiving space 41 to receive food therein and a second receiving space 43 to receive the ice-making unit 60 therein, which are divided by the partition 30.

The front wall 25 defining the first receiving space 41 may be provided with a handle 27 that the user can grip to push or pull the drawer 20. On the other hand, the front wall 25 of the second receiving space 42 to receive the ice-making unit 60 may be provided with an ice-making unit entrance/exit opening 50 to allow the ice-making unit 60 to be pushed into or pulled out of the second receiving space 42.

Since the ice-making unit 60 is slidably pushed into or pulled out of the drawer 20 through the ice-making unit entrance/exit opening 50, a user may pull only the ice-making unit 60 out of the drawer 20 without pulling the drawer 20 out of the freezing compartment 13, and this may improve use convenience and prevent loss of cold air.

The ice-making unit 60 mounted in the second receiving space 43 may be a manual ice-making unit to make ice, which includes an ice-making tray 70 in which ice is made, and an ice receptacle 80 located below the ice-making tray 70 to receive ice made in the ice-making tray 70.

The ice-making tray 70 may be composed of a rectangular frame 71 having open upper and lower sides, an ice-making container 73 rotatably coupled to the frame 71, in which ice is made, and a rotation grip 75 provided at a front surface of the frame 71 and linked to the ice-making container 73 to rotate the ice-making container 73.

The rotation grip 75 is rotatably coaxially coupled to a rotating shaft 72 of the ice-making container 73. If the user turns the rotation grip 75, the ice-making container 73 is rotated and slightly distorted about the rotating shaft 72 of the ice-making container 73 within the frame 71, causing the ice made in the ice-making container 73 to be separated from the ice-making container 73 and fall into the ice receptacle 80 below the ice-making container 73.

The frame 71 may be provided at opposite lateral sides thereof with outwardly protruding support ribs 77 to guide sliding movement of the ice-making tray 70. To support the support ribs 77, first guides 45 may be provided respectively at the sidewall 24 of the drawer 20 defining the second receiving space 43 and at a surface of the partition 30.

Although the ice-making tray 70 of the manual ice-making unit 60 according to the exemplary embodiment is configured to allow the user to separate ice from the ice-making container 73 by turning the rotation grip 75 linked to the ice-making container 73, the configuration of the ice-making tray 70 is not limited thereto. Alternatively, a lever linked to gears may be provided to enable separation of ice from the ice-making tray 70 as the lever is turned to rotate and distort the ice-making tray connected to the gears. That is, any manual ice-making unit is applicable so long as separation of ice by distortion of the ice-making tray 70 is possible.

The ice receptacle 80 may take the form of an upwardly open rectangular box, which is provided at a front surface thereof with a handle 81 that the user can grip to push or pull the ice receptacle 80. The ice receptacle 80 may be further provided at opposite lateral sides thereof with support ribs 83. To slidably support the support ribs 83, second guides 47 may be provided respectively at lower positions of opposite wall surfaces of the second receiving space 43.

The ice-making unit 60 may further include a cold air guide cover 90, which is placed on the top of the ice-making tray 70 to guide cold air into the ice-making tray 70.

The cold air guide cover 90 may have a cold air guide surface 91 to guide movement of cold air, and a plurality of cold air outlet holes 93 through which the cold air moving on the cold air guide surface 91 is discharged downward.

The rear wall 26 of the drawer 20 defining the second receiving space 43 may be perforated with a cold air inlet hole 51 so as to guide cold air from a cold air supply device (not shown) to the ice-making unit 60 mounted in the second receiving space 43.

With this configuration, a part of the cold air, which has moved from the cold air supply device (not shown) into the second receiving space 43 through the cold air inlet hole 51, moves over the cold air guide surface 91 to thereby be discharged downward through the cold air outlet holes 93, thereby being introduced into the ice-making container 73.

The second receiving space 43 of the drawer 20 in which the ice-making unit 60 is mounted may further contain a tray 53 to cover an open upper side of the second receiving space 43. The tray 53 may have a cross sectional area equal to that of the open upper side of the second receiving space 43, thus serving to prevent cold air from leaking from the ice-making unit 60 while preventing impurities from entering the ice-making unit 60.

The tray 53 may have a receiving region 54 to receive small items therein, and a supporting portion 55 supported on upper ends of the front and rear walls 25 and 26 of the drawer 20 to allow an edge of the tray 53 to be supported on an upper end of the vertical wall 22 of the drawer 20. The supporting portion 55, as illustrated in FIG. 4, may be slidably movable leftward or rightward along the upper end of the vertical wall 22 of the drawer 20.

Hereinafter, operation and effects of the drawer of the refrigerator according to the exemplary embodiment will be described.

First, since the ice-making unit 60 is integrally mounted in the drawer 20 that may be pushed into or pulled out of the freezing compartment 13, an unavailable space of the freezing compartment 13 required to install the ice-making unit 60 may be reduced and consequently, space utilization of the freezing compartment 13 may be improved.

Once the ice-making tray 70 of the ice-making unit 60, in which an appropriate amount of water is filled, is received in the second receiving space 43 of the drawer 20, the water is made into ice by cold air supplied from the cold air supply device (not shown) of the refrigerator into the drawer 20 through the cold air inlet hole 51.

In this case, the tray 53 to cover the open upper side of the second receiving space 43 may minimize leakage of the cold air from the second receiving space 43, thereby reducing ice-making time.

Figure 5:
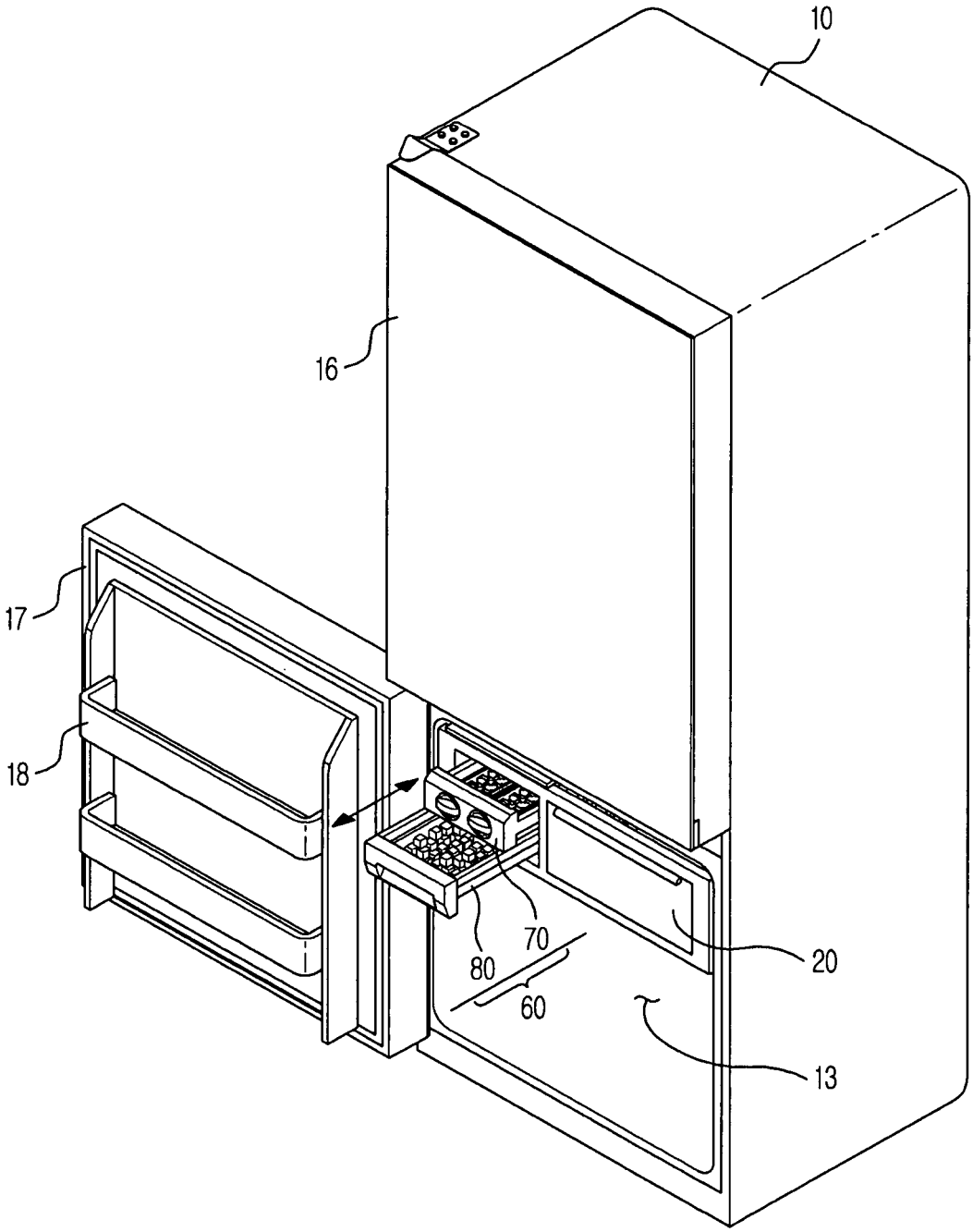
FIG. 5 is a perspective view illustrating a state in which an ice-making unit is pulled out of the refrigerator according to the exemplary embodiment.

When a user wishes to retrieve the ice from the ice-making unit 60, as illustrated in FIG. 5, the user may retrieve the ice by pulling only the ice receptacle 80 from the front side of the freezing compartment 13 without pulling the drawer 20 out of the freezing compartment 13. This may improve use convenience and prevent deterioration in refrigeration efficiency due to loss of cold air.

In addition, when attempting to fill the ice-making tray 70 with water, the user may pull the ice-making tray 70 out of the drawer 20 after the drawer 20 is pulled out of the freezing compartment 13. This increases a pull-out distance, thereby increasing the ease of water replacement.

Hereinafter, the drawer provided with the ice-making unit according to another embodiment will be described. Configurations identical to those of the above-described embodiment will be omitted.

Figure 6:
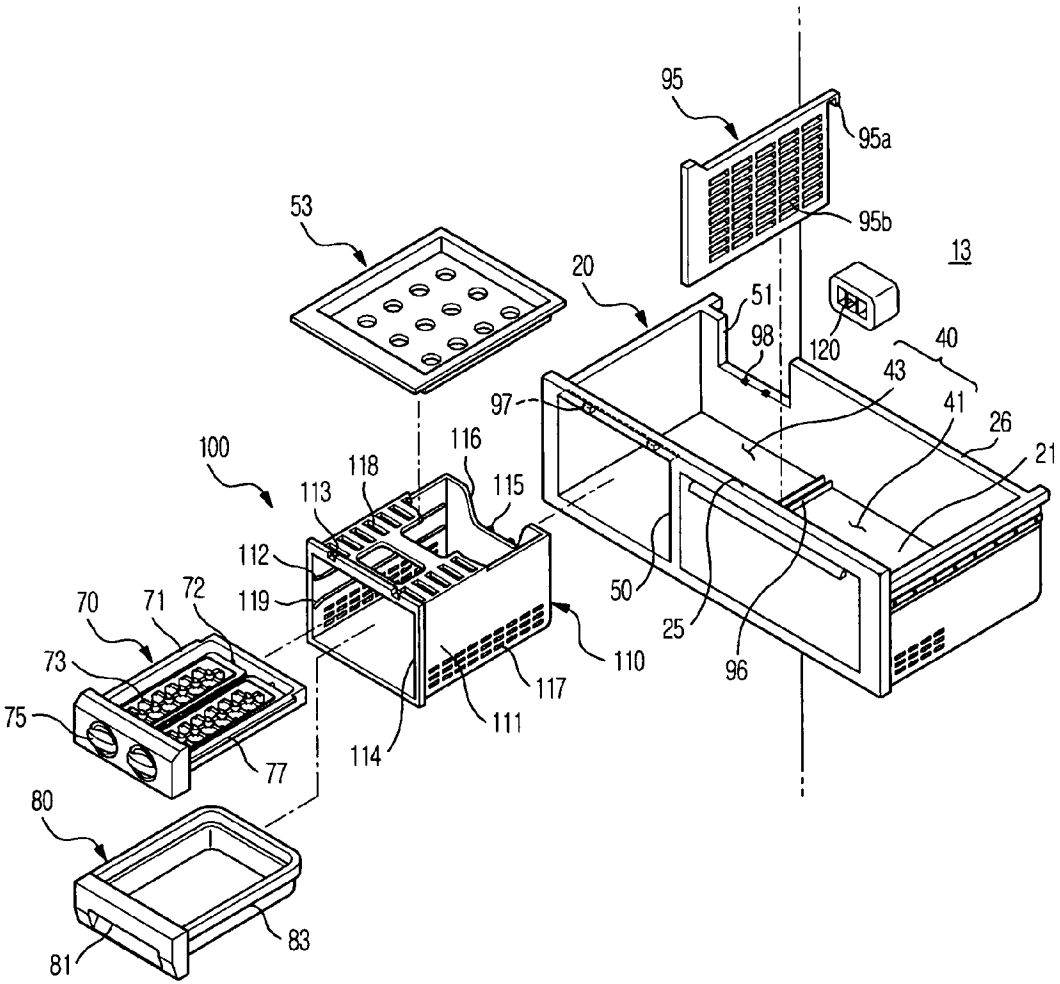
FIG. 6 is a perspective view illustrating the drawer provided with the ice-making unit according to another embodiment.

FIG. 6 is a perspective view illustrating the drawer provided with the ice-making unit according to another embodiment of the present invention.

As illustrated in FIG. 6, the drawer 20 internally defines the receiving space 40 in which food is received. The receiving space 40 may be divided into the first receiving space 41 and the second receiving space 43 by a detachable partition 95.

The bottom surface 21 of the drawer 20 defining the receiving space 40 is provided with an insertion rib 96. The insertion rib 96 extends throughout a width of the receiving space 40 and a lower end of the partition 95 is fixedly inserted into the insertion rib 96.

The partition 95 may be provided at one corner of an upper end thereof with a hook 95*a*. The hook 95*a* may be shaped to surround an upper end rim of the rear wall 26. In addition, the partition 95 may be provided with a plurality of cold air passage holes 95*b*, through which cold air circulates between the first and second receiving spaces 41 and 43.

In the present embodiment, differently from the above-described ice-making unit, an ice-making unit 100 provided in the second receiving space 43 may take the form of a separate assembly and may be mounted in the second receiving space 43.

The ice-making unit 100 may include an ice-making unit housing 110 having a shape corresponding to the second receiving space 43. The ice-making tray 70 and the ice receptacle 80 may be received in the ice-making unit housing 110.

The ice-making unit housing 110 may include a rectangular box-shaped body 111. The body 111 may be inserted into the second receiving space 43 and thereafter, be detachably coupled to the drawer 20.

To this end, the ice-making unit housing 110 may be provided at a front surface thereof with positioning recesses 113, which correspond to positioning bosses 97 provided at inner positions of the front wall 25 of the drawer 20. Also, the ice-making unit housing 110 may be provided at a rear surface thereof with coupling bosses 115 which are fitted into coupling recesses 98 formed in the rear wall 26 of the drawer 20.

The ice-making unit housing 110 may be provided with a plurality of cold air distribution holes 117 and 118 to allow cold air around the ice-making unit housing 110 to be uniformly introduced into the ice-making unit housing 110.

The cold air distribution holes 117 and 118 serve as a passage through which cold air is transmitted from the freezing compartment 13 into the ice-making tray 70. The cold air introduced through the cold air distribution holes 117 and 118 acts to cool the ice-making tray 70 and the ice receptacle 80.

In addition, the ice-making unit housing 110 may be provided at the front surface thereof with a first opening 114. The first opening 114 corresponds to the ice-making unit entrance/exit opening 50 through which the ice-making tray 70 and the ice receptacle 80 enters or exits the drawer 20. The ice-making unit 110 may be further provided at the rear surface thereof with a second opening 116. The second opening 116 has a shape corresponding to the cold air inlet hole 51 perforated in the rear wall 26 toward the second receiving space 40.

First and second guides 112 and 119 are arranged on inner lateral wall surfaces of the ice-making unit housing 110. The first and second guides 112 and 119 are vertically spaced apart from each other and serve to support the ice-making tray 70 and the ice receptacle 80 in a slidable manner. The ice-making tray 70 and the ice receptacle 80 may be provided at opposite sides thereof with supporting ribs 77 and 88 corresponding to the first and second guides 112 and 119.

In the meantime, the freezing compartment 13 may be provided at a rear wall thereof with a cold air discharge tube 120. The cold air discharge tube 120 protrudes from the rear wall into the freezing compartment 13 to supply cold air generated by the cold air supply device (not shown) into the second receiving space 43.

In a state in which the drawer 20 is inserted in the freezing compartment 13, the cold air discharge tube 120 passes through the second opening 116 of the ice-making unit housing 110 and is located at a position adjacent to the rear side of the ice-making tray 70. This facilitates supply of cold air into the ice-making tray 70, resulting in reduced ice-making time.

As is apparent from the above description, a refrigerator having a drawer according to the embodiment may improve space utilization of a storage compartment thereof.

Further, the refrigerator according to the embodiment may improve refrigeration efficiency as well as use convenience when retrieving ice.

Furthermore, the refrigerator according to the embodiment may increase a pull-out distance of an ice-making tray because the drawer is first pulled out and subsequently, the ice-making tray received in the drawer is pulled out. This may increase the ease of water replacement.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A drawer for a refrigerator, configured to be pushed into or pulled out of a storage compartment of the refrigerator, comprising:

a bottom surface, and a vertical wall including a front wall, a rear wall and opposite sidewalls extending upward from a periphery of the bottom surface, wherein the interior of the drawer is divided into a plurality of receiving spaces to receive food, wherein any one of the plurality of receiving spaces receives an ice-making unit to make ice, wherein the front wall defining the receiving space, in which the ice-making unit is received, is provided with an ice-making unit entrance/exit opening to allow the ice-making unit to be pushed into or pulled out of the receiving space, wherein the ice-making unit includes an ice-making tray in which ice is made, and an ice receptacle to store the ice made in the ice-making tray, and at least one of the ice-making tray and the ice receptacle is slidably pushed into or pulled out of the receiving space through the ice-making unit entrance/exit opening.

2. The drawer according to claim 1, further comprising a tray to cover an upper side of the receiving space in which the ice-making unit is received.

3. The drawer according to claim 2, wherein the tray is supported on an upper end of the vertical wall of the drawer in a sliding movable manner.

4. The drawer according to claim 1, wherein the drawer is provided with a cold air inlet hole, through which cold air is supplied into the ice-making unit.

5. The drawer according to claim 4, wherein the cold air inlet hole is provided at the rear wall.

6. The drawer according to claim 1, wherein the ice-making tray includes a frame having open upper and lower sides, an ice-making container rotatably placed in the frame, in which ice is made, and a rotation grip provided at a front surface of the frame and connected to the ice-making container to rotate the ice-making container.

7. A refrigerator comprising:

a storage compartment including a refrigerating compartment and a freezing compartment;

a door to open or close the storage compartment;

a drawer provided to be pushed into or pulled out of the storage compartment and serving to receive food therein, the drawer being arranged in the freezing compartment;

a partition to divide the interior of the drawer into a plurality of independent receiving spaces;

an ice-making unit received in any one of the plurality of receiving spaces and serving to make ice; and an ice-making unit entrance/exit opening provided in a portion of a vertical wall of the receiving space in which the ice-making unit is received, to allow the ice-making unit to be pushed into or pulled out of the receiving space, the ice-making unit including an ice-making tray in which ice is made, and an ice receptacle to store the ice made in the ice-making tray, wherein at least one of the ice-making tray and the ice receptacle is slidably pushed into or pulled out of the receiving space through the ice-making unit entrance/exit opening.

8. The refrigerator according to claim 7, wherein a cold air inlet hole, through which cold air is supplied into the ice-making unit, is provided in a wall of the drawer defining the receiving space in which the ice-making unit is received.

9. The refrigerator according to claim 8, wherein the ice-making unit further includes a cold air guide cover placed on the ice-making tray.

10. The refrigerator according to claim 8, wherein the drawer includes a tray to cover an upper side of the receiving space in which the ice-making unit is received.

11. The refrigerator according to claim 10, wherein the tray is supported on an upper end of the drawer in a sliding movable manner.

12. The refrigerator according to claim 7, wherein the ice-making tray includes a frame, an ice-making container rotatably placed in the frame, in which ice is made, and a rotation grip provided at a front surface of the frame and rotatably linked to the ice-making container.

13. The refrigerator according to claim 7, wherein the ice-making unit is a manual icemaker in which ice is separated from the ice-making tray via distortion of the ice-making tray.

14. A refrigerator comprising:

a freezing compartment;

a drawer installed in the freezing compartment in a sliding movable manner and having a bottom surface and a vertical wall provided at a front surface thereof with an ice-making unit entrance/exit opening, the drawer internally defining an ice-making unit receiving space divided by a partition to receive the ice-making unit therein; and an ice-making unit including an ice-making tray to make ice and an ice receptacle to store the ice discharged from the ice-making tray via distortion of the ice-making tray, wherein the ice-making unit includes an ice-making unit housing inserted into the ice-making unit receiving space, and the ice-making tray and the ice receptacle are installed in the ice-making unit housing in a sliding movable manner so as to be pushed into or pulled out of the ice-making unit receiving space through the ice-making unit entrance/exit opening.

15. The refrigerator according to claim 14, wherein a cold air discharge tube protrudes from a rear wall of the freezing compartment and extends through the drawer and the ice-making unit housing so as to be located adjacent to the ice-making tray.

16. The refrigerator according to claim 15, wherein the ice-making unit housing includes a hexahedral body having a first opening provided at a front surface thereof to correspond to the ice-making unit entrance/exit opening, a second opening provided at a rear surface thereof, through which the cold air discharge tube penetrates, and a plurality of cold air passage holes perforated in a periphery thereof.

17. The refrigerator according to claim 14, wherein the bottom surface is provided with an insertion rib extending in a transversal direction of the drawer such that the partition is fixedly inserted in the insertion rib, and the partition is provided with a hook configured to surround an upper end rim of the vertical wall.

* * * * *

UNITED STATES PATENT AND TRADEMARK OFFICE

CERTIFICATE OF CORRECTION

PATENT NO. : 8,733,122 B2
APPLICATION NO. : 13/064472
DATED : May 27, 2014
INVENTOR(S) : Lim et al.

It is certified that error appears in the above-identified patent and that said Letters Patent is hereby corrected as shown below:

On the Title Page Item [75] (Inventors), Line 2, delete "Jeonam" and insert -- Jeonnam --, therefor.

Signed and Sealed this
Nineteenth Day of August, 2014

Michelle K. Lee

Michelle K. Lee
*Deputy Director of the United States Patent and Trademark Office*